US010159399B2

(12) United States Patent
Choi et al.

(10) Patent No.: US 10,159,399 B2
(45) Date of Patent: Dec. 25, 2018

(54) DUST SUCTION APPARATUS

(71) Applicant: DAESHIN MC CORPORATION, Seoul (KR)

(72) Inventors: Young Hwan Choi, Seoul (KR); Changno Yoon, Seoul (KR)

(73) Assignee: DAESHIN MC CORPORATION, Seoul (KR)

( * ) Notice: Subject to any disclaimer, the term of this patent is extended or adjusted under 35 U.S.C. 154(b) by 202 days.

(21) Appl. No.: 15/220,581

(22) Filed: Jul. 27, 2016

(65) Prior Publication Data

US 2017/0042405 A1 Feb. 16, 2017

(30) Foreign Application Priority Data

Aug. 12, 2015 (KR) ..... 10-2015-0114054

(51) Int. Cl.

| | |
|---|---|
| ***A47L 23/24*** | (2006.01) |
| ***A47L 9/14*** | (2006.01) |
| ***A47L 23/26*** | (2006.01) |
| ***A47L 7/00*** | (2006.01) |
| ***A47L 23/02*** | (2006.01) |

(52) U.S. Cl.
CPC ..... *A47L 23/24* (2013.01); *A47L 7/0066* (2013.01); *A47L 9/1409* (2013.01); *A47L 23/02* (2013.01); *A47L 23/263* (2013.01)

(58) Field of Classification Search
CPC ..... A47L 23/02; A47L 23/24; A47L 23/263; A47L 7/0066; A47L 9/1409
See application file for complete search history.

(56) References Cited

U.S. PATENT DOCUMENTS 8,533,901 B2 * 9/2013 Williams ..... A47L 23/263 15/303
2010/0011962 A1 * 1/2010 Totsugi ..... A47L 9/281 96/400

FOREIGN PATENT DOCUMENTS

| | | | | |
|---|---|---|---|---|
| JP | 2014-233324 | A | | 12/2014 |
| JP | 2014233324 | A | * | 12/2014 |
| KR | 20-2010-0011431 | U | | 11/2010 |
| KR | 20100011431 | U | * | 11/2010 |
| KR | 10-1124381 | B1 | | 3/2012 |
| KR | 10-2013-0040394 | A | | 4/2013 |
| KR | 10-1255054 | B1 | | 4/2013 |
| KR | 20130040394 | A | * | 4/2013 |
| KR | 10-1266854 | B1 | | 5/2013 |
| KR | 10-1271559 | B1 | | 6/2013 |

(Continued)

OTHER PUBLICATIONS

KR 20130040394 A—English Machine Translation.*

(Continued)

*Primary Examiner* — Marc Carlson
(74) *Attorney, Agent, or Firm* — Korus Patent, LLC; Seong Il Jeong

(57) ABSTRACT

There is provided a dust suction apparatus comprising: a base; a side frame wherein the base and frame defines a dust suction space; a dust suction panel disposed in the dust suction space; and a dust-collection device air-communicated with the dust suction panel, wherein the dust suction panel includes a plurality of dust suction panel modules, wherein the dust suction panel modules are mounted in the dust suction space in a modular fashion to allow the plurality of dust suction panel modules to be removed individually.

16 Claims, 13 Drawing Sheets

(56) References Cited

FOREIGN PATENT DOCUMENTS

| | | | | |
|---|---|---|---|---|
| KR | 10-1278518 | B1 | | 6/2013 |
| KR | 10-1310888 | B1 | | 9/2013 |
| KR | 10-1312884 | B1 | | 9/2013 |
| KR | 10-1330699 | B1 | | 11/2013 |
| KR | 101330699 | B1 | * | 11/2013 |
| KR | 10-1477217 | B1 | | 12/2014 |
| KR | 101477217 | B1 | * | 12/2014 |

OTHER PUBLICATIONS

KR 20100011431 U—English Machine Translation.*
KR 101477217 B1—English machine translation.*
JP 2014233324 A—English machine translation.*
McMaster Carr Catalog 121 (2015)—p. 2105.*

* cited by examiner

DUST SUCTION APPARATUS

CROSS-REFERENCE TO RELATED APPLICATION

This application claims the benefit of Korea Patent Application No. 10-2015-0114054, filed on Aug. 12, 2015, the entire content of which is incorporated herein by reference for all purposes as if fully set forth herein.

BACKGROUND

Field of the Present Disclosure

The present disclosure relates to a dust suction apparatus, and, more particularly, to a dust suction apparatus to remove a dust on shoes of a person entering a specific space.

Discussion of the Related Art

A clean room where it is critical to handle a variety of dust and contaminants has been used mostly in the semiconductor related fields. However, recently, the clean room is gradually expanded to various chemicals and food manufacturing companies, and hospitals.

As the industry development improves rapidly, not only air pollutants including dusts generated from the factory should be removed, but also dusts generated from a variety of automotive and construction facilities and attached to the shoes of the human body should be removed in public places.

Thus, a dust suction apparatus which can mainly remove the dust deposited on shoes has been installed at the entrance of each facility. This may require the installation space of the dust suction apparatus. Further, when many people are entering into the facility, congestion occurs in front of the dust suction apparatus.

For most of prior art dust suction apparatuses, a user foot is put on the dust suction apparatus and thus, a dust suction switching protrusion is moved to open a suction hole to allow the dust together with an air to be suctioned. In this connection, the dust suction switching protrusion is spring-loaded. However, the long hair strands and/or long textile fibers suctioned in the dust suction apparatus may be stuck in the hole when the suction is deactivated and thus the dust suction switching protrusion is engaged with the hole. Subsequently, the long hair strands and/or long textile fibers stuck in the hole may move out of the hole due to an external shock or winds.

The dust suction switching protrusions are integrated into a single panel. Thus, when it is necessary to clean or repair the dust suction apparatus due to a damaged protrusion and/or excessive dust depositions, it may be difficult to remove or disassembly the dust suction switching protrusion.

The prior art dust suction apparatuses may be disclosed in following documents:

patent document 1: Korean Patent No. 10-1124381-0000 (2012, 02, 29);

patent document 2: Korean Patent No. 10-1255054-0000 (2013, 04, 10);

patent document 3: Korean Patent No. 10-1271559-0000 (2013, 05, 30);

patent document 4: Korean Patent No. 10-1278518-0000 (2013, 06, 19);

patent document 5: Korean Patent No. 10-1310888-0000 (2013, 09, 13); and patent document 6 Korean Patent No. 10-1477217-0000 (2014, 12, 22).

SUMMARY

Thus, the present disclosure provides a dust suction apparatus having a suction panel including plural dust suction panel modules mounted in a modular fashion to in the dust suction space in a modular fashion to allow the plurality of dust suction panel modules to be removed individually for the cleaning or repairing thereof.

Further, the present disclosure provides a dust suction apparatus to prevent the dust or hair strands from being scattered toward an ambient space due to an external shock or wind when the dust or hair strands are suctioned and then the suction operation stops due to removal of the user foot from the suction panel.

In one aspect, there is provided a dust suction apparatus comprising: a base; a side frame wherein the base and frame defines a dust suction space; a dust suction panel disposed in the dust suction space; and a dust-collection device air-communicated with the dust suction panel, wherein the dust suction panel includes a plurality of dust suction panel modules, wherein the dust suction panel modules are mounted in the dust suction space in a modular fashion to allow the plurality of dust suction panel modules to be removed individually.

In one implementation, each dust suction panel module includes a grating panel including; a plurality of first spaced walls extending in a first direction; a plurality of second spaced walls extending in a seconding direction perpendicular to the first direction; a plurality of protrusion receiving structures, where each of the plurality of protrusion receiving structures has a protrusion receiving hole defined therein, wherein the plurality of protrusion receiving holes is arranged in a matrix form; and lateral walls to connect to each other to surround the first and second spaced walls.

In one implementation, each dust suction panel module further includes a bottom panel coupled to the grating panel, wherein the bottom panel has a plurality of through-holes, each through-hole corresponding to each protrusion receiving hole of the grating panel, wherein the bottom panel has a tilted face portion extending around the through-hole, wherein the bottom panel has a plurality of spacer upper protrusions to be arranged to be spaced from each other, wherein each bottom panel has a plurality of lower support spaced walls extending between the through-holes in the first direction.

In one implementation, each dust suction panel module further includes a plurality of protrusion received in the protrusion receiving holes respectively.

In one implementation, wherein each protrusion has an inwardly stepped portion, wherein, between the inwardly stepped portion and the bottom of the protrusion receiving structure, a compression coil spring is disposed.

In one implementation, each protrusion has a screw hole formed therein centrally from a bottom thereof, wherein the screw hole communicates with the protrusion receiving hole.

In one implementation, each switching member is removeably coupled to each through-hole.

In one implementation, the switching member tapers upwardly.

In one implementation, the switching member has a mounting hole vertically defined centrally therein, and a fixing bolt passes through the mounting hole and is coupled to the screw hole of the protrusion.

In one implementation, a top level of each of the first spaced walls is higher than a top level of each of the second spaced walls, wherein each of the protrusion receiving structures has a top level flush with the top levels of the first spaced walls and having a bottom level lower than the bottom levels of the first and second spaced walls.

In one implementation, each of the protrusion receiving holes has a main horizontal diameter, and each of the protrusion receiving structures has a bottom portion having a secondary hole defined therein having a smaller horizontal diameter than the main horizontal diameter.

In one implementation, each of the lateral walls has a bottom level lower than the bottom levels of the first and second spaced walls and the bottom levels of the protrusion receiving structures.

In one implementation, each of two facing-away lateral walls of the lateral walls has an air-communication hole.

In one implementation, each of the lateral walls of the grating panel has a sealing groove defined in a bottom thereof, wherein the sealing groove receives therein a sealing.

In one implementation, each through-hole is larger than each protrusion receiving hole in a horizontal diameter.

In one implementation, the bottom panel has a plurality of lower support spaced walls extending between the through-holes in the first direction.

In one implementation, the bottom panel has a plurality of lower support pins arranged in a line between the two air-communication holes and the lower support pins are spaced from each other.

In one implementation, the bottom panel has a sealing groove formed in and along an outer edge thereof, wherein a sealing is air-tightly received in the sealing groove and between the outer edge of the panel and the lateral wall of the grating panel.

In one implementation, one of two portions of the two facing-away lateral walls having the two air-communication holes respectively has an open bottom and protrudes along an inverse 'U' shape and outwardly.

In one implementation, a sealing groove is formed along and in the inverse 'U' shape of the air-communication hole portion, and a sealing is air-tightly received in the sealing groove, wherein the other of the two potions receives an air-communication hole portion with an inverse 'U' shape protrusion of a neighboring grating panel to pressure-contact the sealing received in the air-communication hole portion of the neighboring grating panel.

In one implementation, the bottom panel has lower support pins arranged in the second direction centrally thereon, and a plurality of lower support spaced walls extending between the through-holes in the first direction, and wherein the plurality of lower support spaced walls 124 are arranged in a symmetrical manner relative to an arrangement of the central pins.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

Figure 1:
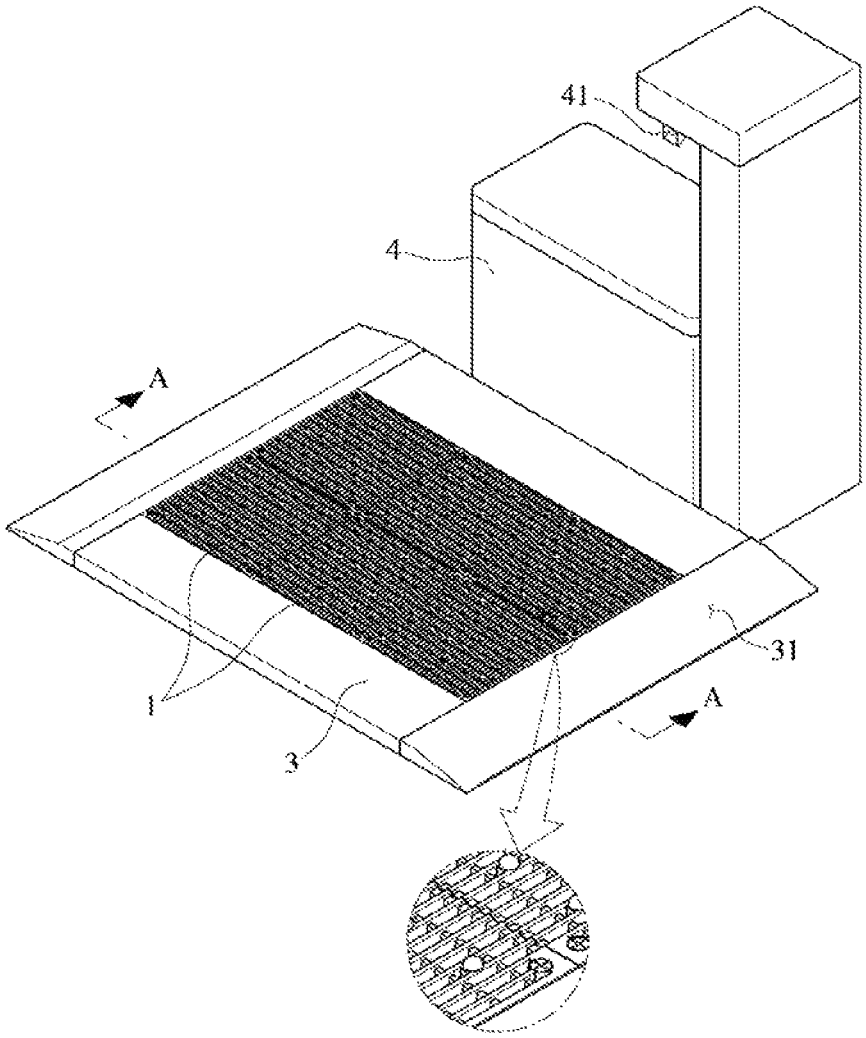
FIG. 1 is a perspective view of a dust suction apparatus in accordance with one embodiment of the present disclosure.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath,""below,""lower,""under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Further, the use of "may" when describing embodiments of the present disclosure refers to "one or more embodiments of the present disclosure."

Hereinafter, embodiments of the present disclosure will be described in details with reference to attached drawings.

Figure 2:
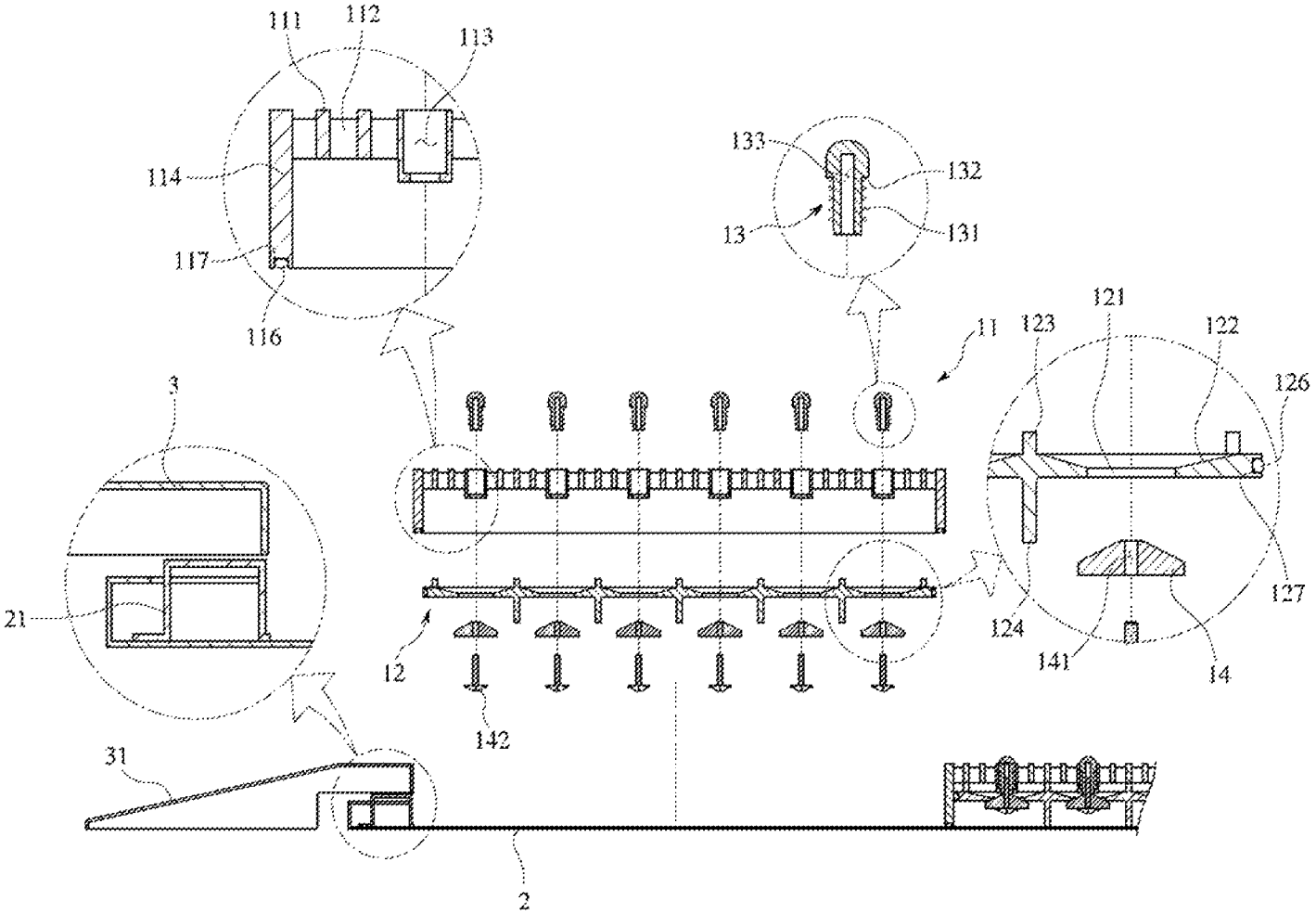
FIG. 2 is an exploded view for explaining a configuration of a dust suction panel of a dust suction apparatus in accordance with one embodiment of the present disclosure.
Figure 3:
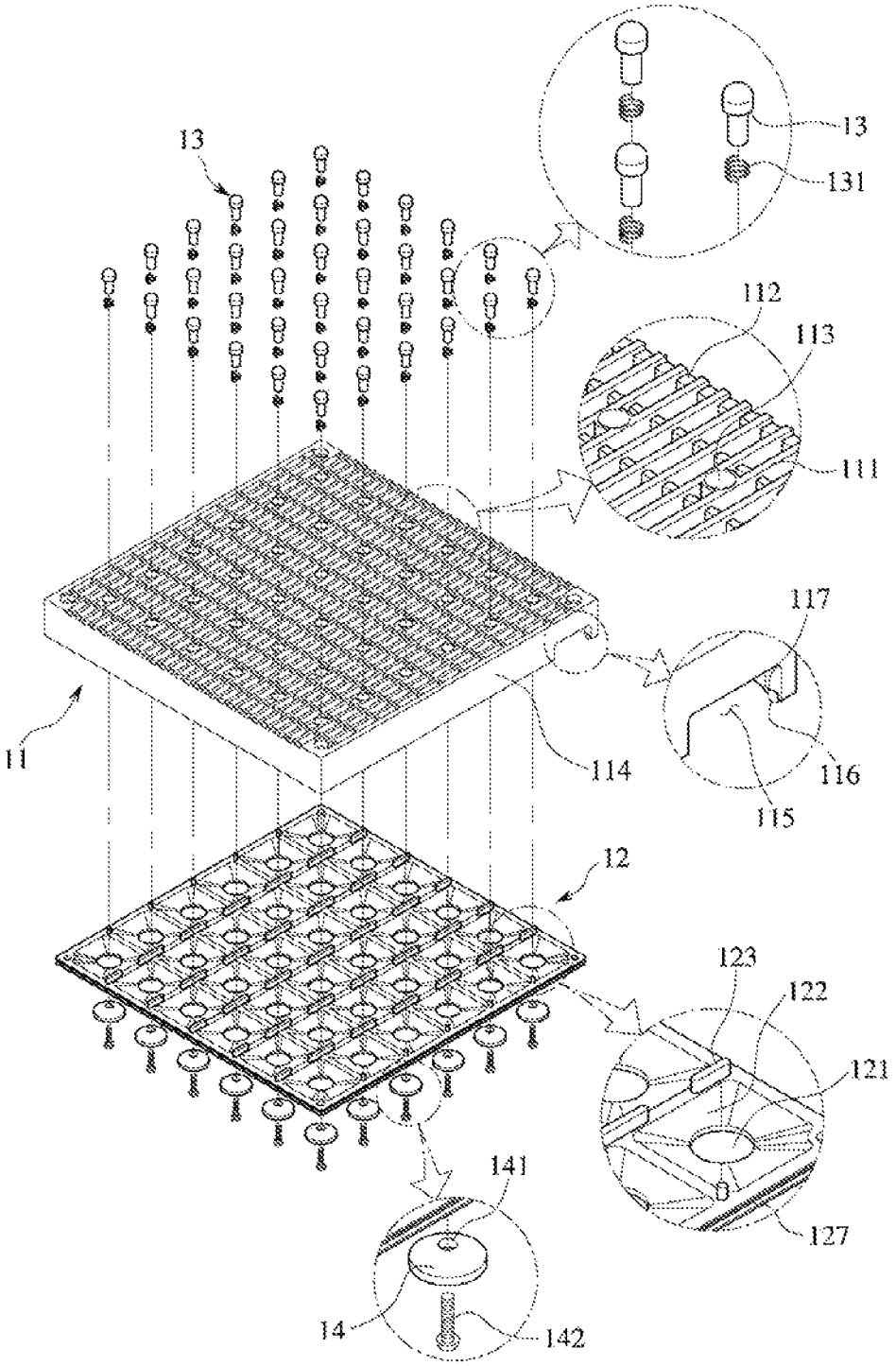
FIG. 3 is an exploded perspective view of a dust suction panel of a dust suction apparatus in accordance with one embodiment of the present disclosure.
Figure 4:
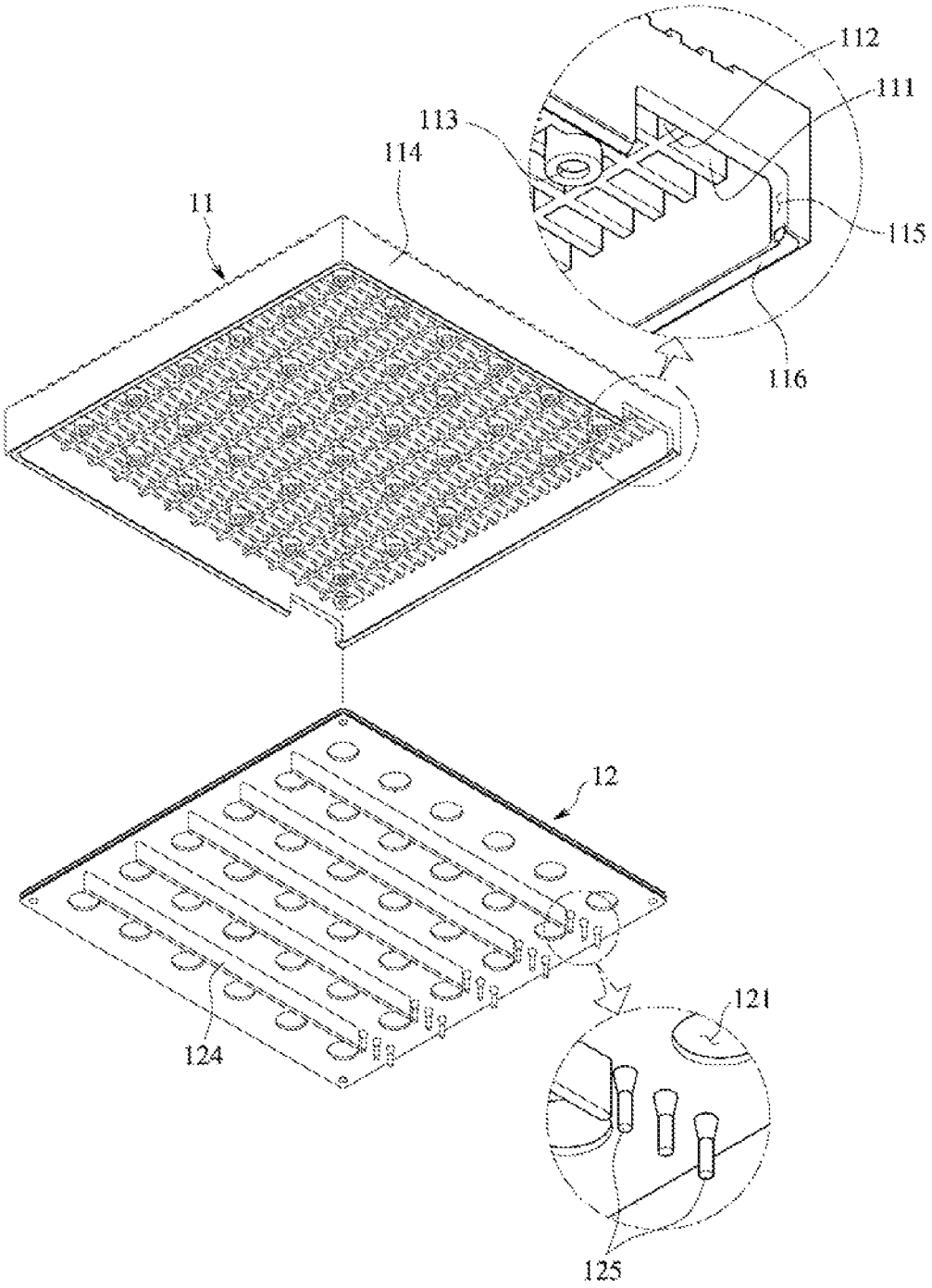
FIG. 4 is a bottom perspective view of a grating panel and a bottom panel of a dust suction apparatus in accordance with one embodiment of the present disclosure.
Figure 5:
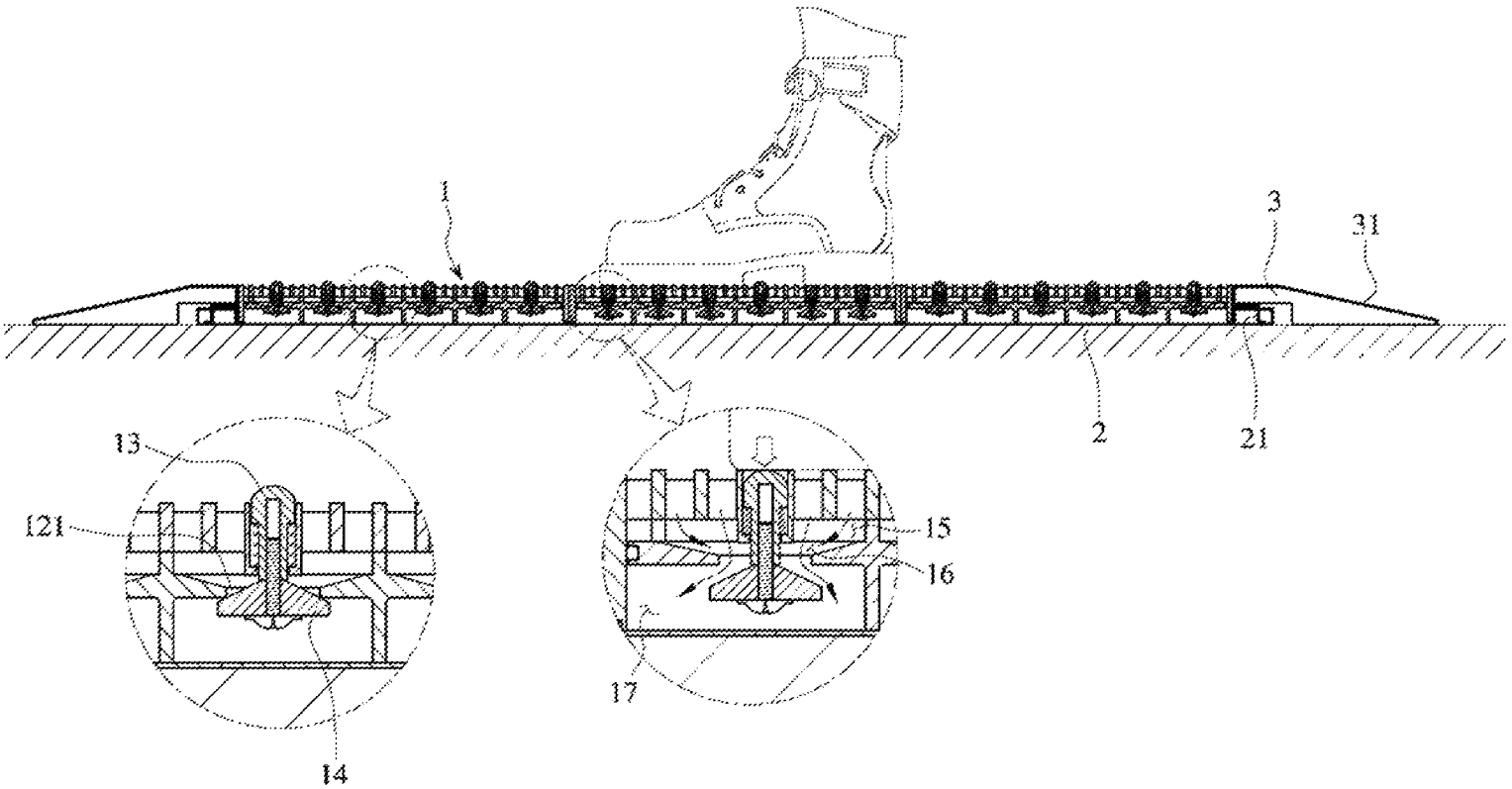
FIG. 5 is a cross-sectional view for describing an operation of a dust suction apparatus in accordance with one embodiment of the present disclosure.
Figure 6:
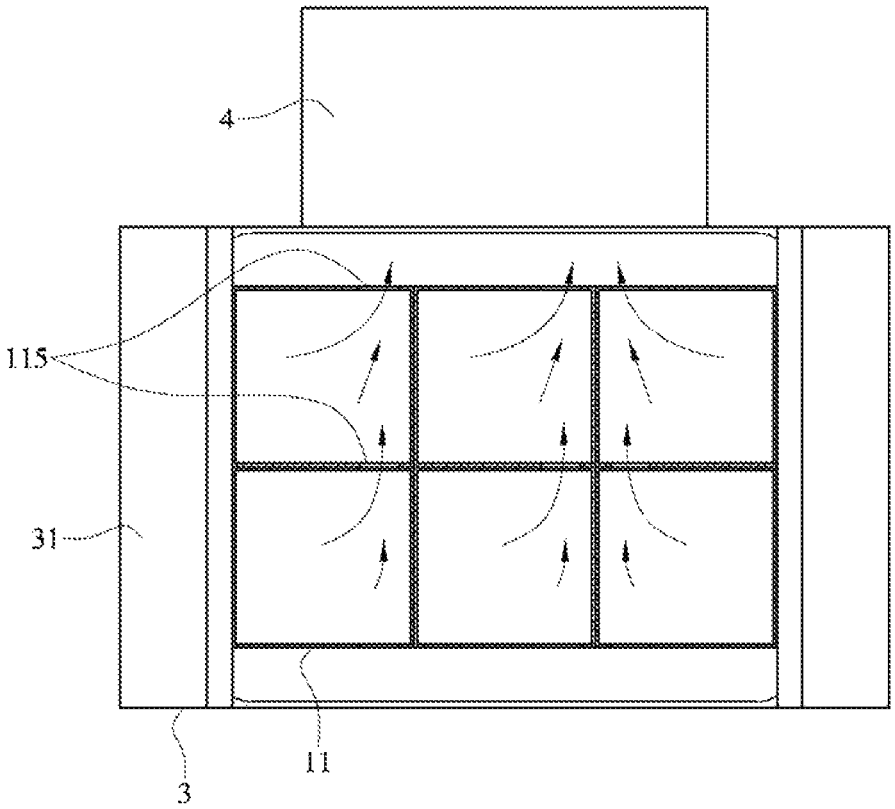
FIG. 6 is a high level view for describing an air flow in a dust suction apparatus in accordance with one embodiment of the present disclosure.

FIG. 1 is a perspective view of a dust suction apparatus in accordance with one embodiment of the present disclosure. FIG. 2 is an exploded view for explaining a configuration of a dust suction panel of a dust suction apparatus in accordance with one embodiment of the present disclosure. FIG. 3 is an exploded perspective view of a dust suction panel of a dust suction apparatus in accordance with one embodiment of the present disclosure. FIG. 4 is a bottom perspective view of a grating panel and a bottom panel of a dust suction apparatus in accordance with one embodiment of the present disclosure. FIG. 5 is a cross-sectional view for describing an operation of a dust suction apparatus in accordance with one embodiment of the present disclosure. FIG. 6 is a high level view for describing an air flow in a dust suction apparatus in accordance with one embodiment of the present disclosure.

The dust suction apparatus in accordance with one embodiment of the present disclosure may include a dust suction panel 1, a base 2, a frame 3, and a dust-collection device 4. In the dust suction apparatus in accordance with one embodiment of the present disclosure, a space for dust suction may be defined by the base 2 and frame 3, and a plurality of dust suction panels 1 are mounted in a modular fashion to allow the plurality of dust suction panels 1 to be removed individually.

To be specific, the dust suction panel 1 may include a grating panel 11. The grating panel 11 may include a plurality of first spaced walls 111 extending in a first direction and a plurality of second spaced walls 112 extending in a seconding direction perpendicular to the first direction. A top level of each of the first spaced walls 111 is higher than a top level of each of the second spaced walls 112. The grating panel 11 may include a plurality of circular protrusion receiving structures, where each of the plurality of circular protrusion receiving structures has a protrusion receiving hole 113 defined therein. Each of the protrusion receiving structures has a top level flush with the top levels of the first spaced walls 111 and having a bottom level lower than the bottom levels of the first and second spaced walls 111, 112. The plurality of circular protrusion receiving holes 113 may be arranged in a matrix form. Each of the protrusion receiving holes 113 has a main horizontal diameter. Each of the protrusion receiving structures has a bottom portion having a secondary hole defined therein having a smaller horizontal diameter than the main horizontal diameter. The grating panel 11 may include four lateral walls 114 to connect to each other to surround the first and second spaced walls 111 and 112. Each of the four lateral walls 114 has a bottom level lower than the bottom levels of the first and second spaced walls 111 and 112 and the bottom levels of the protrusion receiving structures. Each of two facing away lateral walls 114 of the four lateral walls 114 may have an air-communication hole 115. For example, the air-communication hole 115 may be formed at one longitudinal end of each of two facing away lateral walls 114 as shown in FIG. 2. However, the present disclosure is not limited thereto.

The grating panel 11 may be made of a steel. However, the present disclosure is not limited thereto. The grating panel 11 may be open at a bottom portion thereof to receive therein a bottom panel 12. The lateral walls 114 of the grating panel 11 may have a durability against a vertical pressure.

In one embodiment, each of the lateral walls 114 of the grating panel 11 may have a first sealing groove 117 defined at a bottom thereof. Each first sealing groove 117 may receive therein a first sealing 116. In this way, the grating panel 11 may air-tightly contact the base 2.

In the present disclosure, the plurality of dust suction panels 1 may include the plurality of the grating panels 11 respectively. As shown in FIG. 6, when the plurality of the grating panels 11 are arranged, the air may flow via the air-communication holes 115 to the dust-collection device 4 using a suction force of the dust-collection device 4. In this connection, the air-communication holes 115 may be distributed to allow a uniform pressure distribution and air flow between the plurality of dust suction panels 1.

The plurality of dust suction panels 1 may include the plurality of the bottom panels 12 respectively. The plurality of the bottom panels 12 may be coupled to the grating panels 11 respectively. Each bottom panel 12 may have a plurality of through-holes 121, each through-hole 121 corresponding to each protrusion receiving hole 113 of the grating panel. Each through-hole 121 may be larger than each protrusion receiving hole 113 in a horizontal diameter. Each bottom panel 12 may have each tilted face portion 122 extending around the through-hole 121. Each bottom panel 12 may have a plurality of spacer upper protrusions 123 to be arranged to be spaced from each other. The spacer upper protrusions 123 may be formed between adjacent the tilted face portion 122, and between the tilted face portion 122 and an adjacent edge of the bottom panel. Each bottom panel 12 may have a plurality of lower support spaced walls 124 extending between the through-holes 121 in the first direction. Each bottom panel 12 may have a plurality of lower support pins 125 arranged in a line between the two air-communication holes 115. The plurality of lower support pins 125 may be spaced from each other.

The bottom panel 12 may contact the base 2 at the lower support spaced walls 124 thereof. The lower support spaced walls 124 may act to define spaces with adjacent lower support spaced walls 124 and/or the lateral walls 114.

The spacer upper protrusions 123 may contact a bottom of the grating panel 11. The spacer upper protrusions 123 may be spaced from each other in a linear direction to allow the air to flow through the spacing therebetween.

Between the spacer upper protrusions 123 and the grating panel 11, and the tilted face portion 122, first and second spaces 15 and 16 may be defined. Under the through-hole 121, a third space 17 may be formed. This is shown in an inset of FIG. 5.

When the dust or hair strands are suctioned and then the suction operation stops due to removal of the user foot from the suction panel 1, the dust or hair strands are still trapped in the first space 15 to prevent the dust or hair strands from being scattered toward an ambient space due to an external shock or wind.

In the second space 16, the suction speed may improve due to a gradually narrow diameter downwards. In the third space 17, the suctioned dust may stay therein or may pass therethrough.

Further, a plurality of protrusion 13 may be received in the protrusion receiving holes 113 respectively. Each protrusion 13 may have an inwardly stepped portion 132. Between the inwardly stepped portion 132 and the bottom of the protrusion receiving structure, a compression coil spring 131 may be disposed. Each protrusion 13 may have a screw hole 133 formed therein centrally from the bottom thereof. The screw hole 133 may communicate with the secondary hole of the protrusion receiving structure.

Furthermore, each switching member 14 may be removeably coupled to each through-hole 121. Each switching member 14 may taper upwardly. Each switching member 14 may have a mounting hole 141 vertically defined centrally therein. A fixing bolt 142 may pass through the mounting hole 141 and then may pass through the secondary hole and then may be coupled to the screw hole 133 of the protrusion 13.

In this way, when the user foot is put on and pushes down the protrusion 13, the protrusion 13 may lower down and thus the switching member 14 may open the through-hole 121 to allow an external air to be suctioned into the inner space in the suction panel in a vacuum state. Thus, contaminants such as the dust on the shoes of the user may be suctioned into the inner space in the suction panel.

Further, the bottom panel 12 may have a second sealing groove 127 formed in and along an outer edge thereof. A second sealing 126 may be air-tightly received in the second sealing groove 127 and between the outer edge of the panel 12 and the lateral walls 114 of the grating panel 12. Thus, the vacuum state in the third space 17 may be effectively maintained.

The dust suction panel 1 may include a plurality of the dust suction panels 1 arranged in a matrix form. The plurality of the dust suction panels 1 may be rested on the base 2. The base 2 may have an edge portion 21 having a height smaller than the dust suction panel 1.

The dust suction apparatus in accordance with one embodiment of the present disclosure may include the four frames 4 and the dust-collection device 4. The frames 3 may surround the plurality of the dust suction panels 1. Each frame 3 may have an inner inwardly stepped portion which rests on the edge portion 21 of the base 2. Optionally, two frames 3 may have tilted top faces 31 to prevent the user from striking the frames 3.

The dust-collection device 4 may have a portion adjacent to one of the frames 3 and installed therein. The dust-collection device 4 may be configured to suction and filter the dust. The dust-collection device 4 may have a sensing unit 41 to sense a presence of the person and thus to drive the dust-collection device 4. The sensing unit 41 may have a variety of types of sensors to sense the present of the object. In an alternative, when the user or a touch card contacts the sensing unit 41, the sensing unit 41 may sense a presence of the person and thus to drive the dust-collection device 4.

Figure 7:
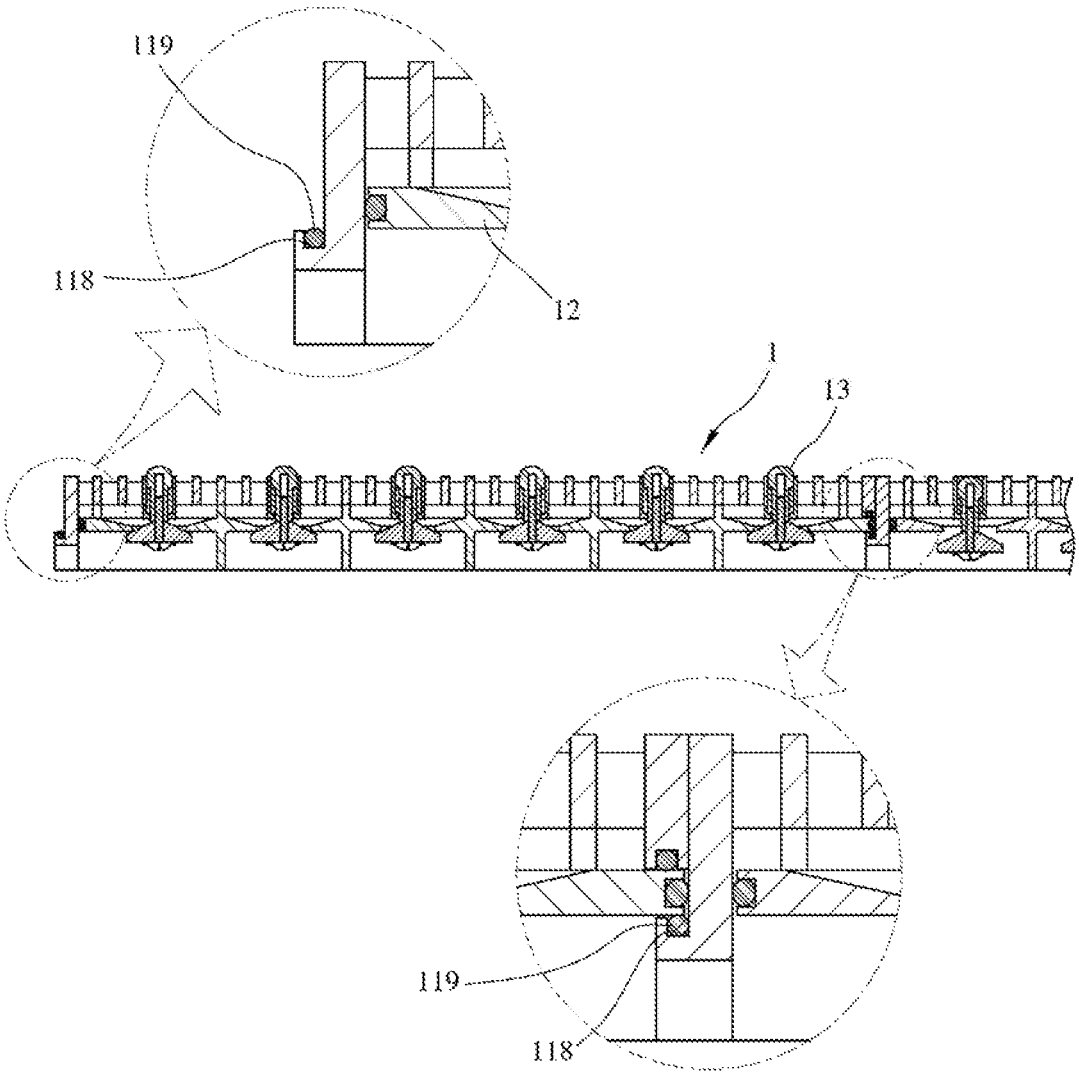
FIG. 7 is a perspective view of a configuration of a grating panel in accordance with another embodiment of the present disclosure.
Figure 8:
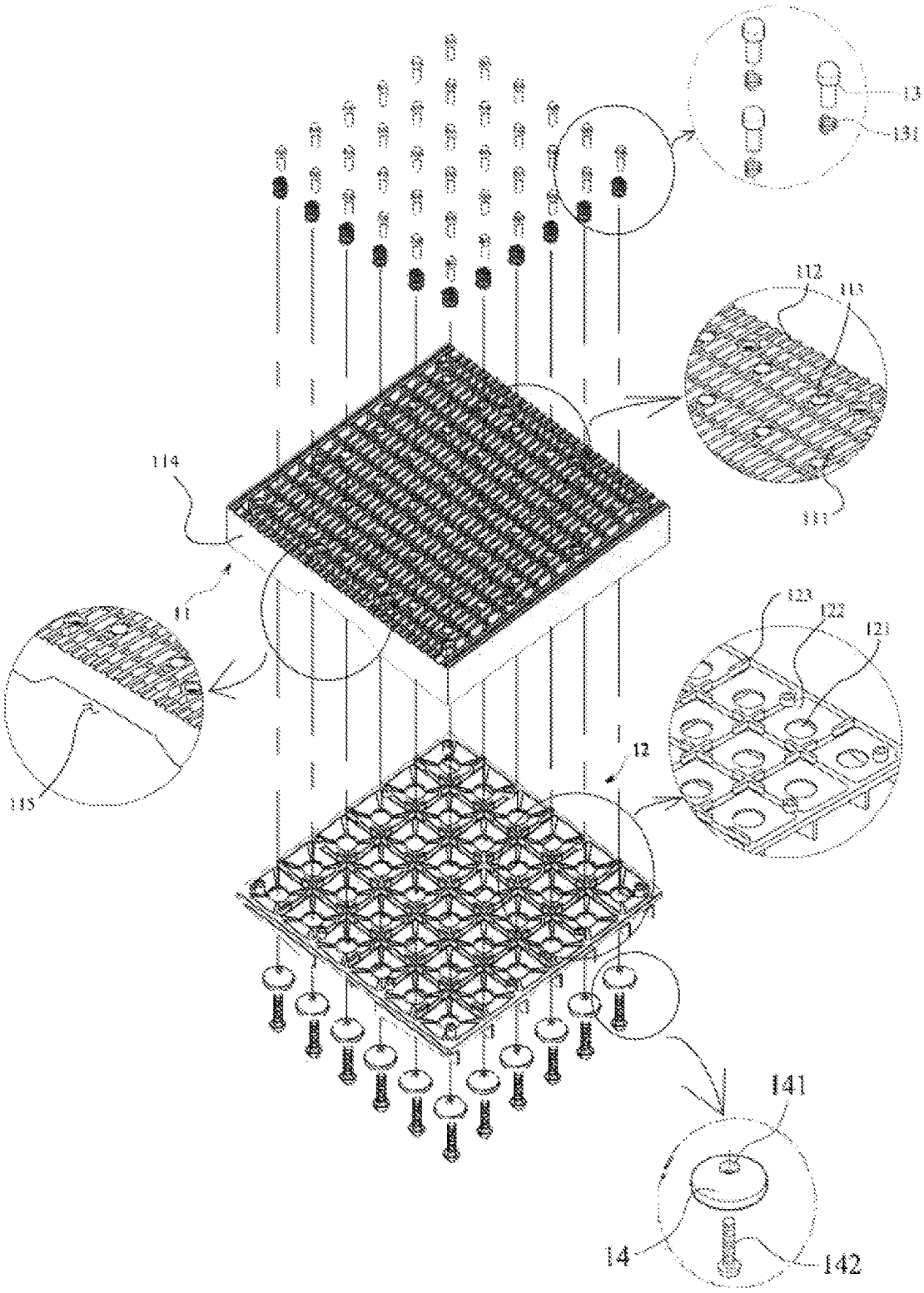
FIG. 8 is an exploded perspective view of a dust suction panel of a dust suction apparatus in accordance with still another embodiment of the present disclosure.

FIG. 7 is a perspective view of a configuration of a grating panel in accordance with another embodiment of the present disclosure. FIG. 8 is a cross sectional view of a grating panel in FIG. 7.

Referring to FIG. 7, the grating panel 11 in accordance with another embodiment of the present disclosure may include two air-communication hole portions 115. One of the two air-communication hole portions 115 may have an open bottom and may protrude along the inverse 'U' shape and outwardly. A third sealing groove 119 may be formed along and in the inverse 'U' shape of the air-communication hole portion 115. A third sealing 118 may be air-tightly received in the third sealing groove 119. The other of the two air-communication hole portions 115 may receive an air-communication hole portion with the inverse 'U' shape protrusion of a neighboring grating panel 11 to pressure-contact the third sealing 118 received in the air-communication hole portion of the neighboring grating panel 11.

When the grating panels 11 may be arranged in a matrix form, the adjacent air-communication hole portions 115 may be coupled to each other. In this state, a gap between the neighboring lateral walls 114 may be formed to lower the suction effect.

In order to solve this issue, one of the adjacent air-communication hole portions 115 protrudes outwardly while the other of the adjacent air-communication hole portions 115 receives said one therein. At the same time, between the adjacent air-communication hole portions 115, the third sealing 118 may be air-tightly disposed to improve the sealing effect.

Figure 9:
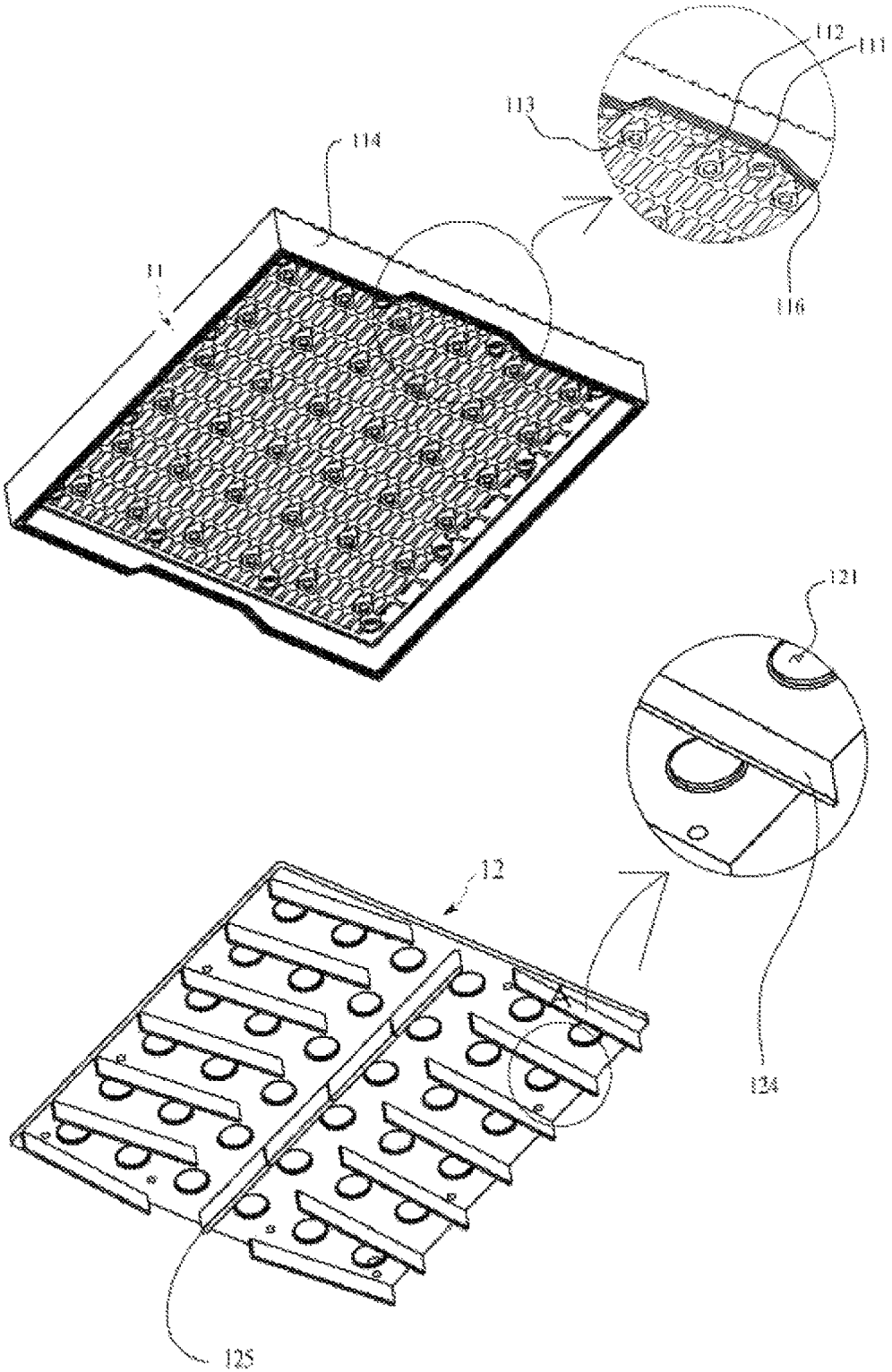
FIG. 9 is a bottom perspective view of a grating panel and a bottom panel of a dust suction apparatus in accordance with still another embodiment of the present disclosure.
Figure 10:
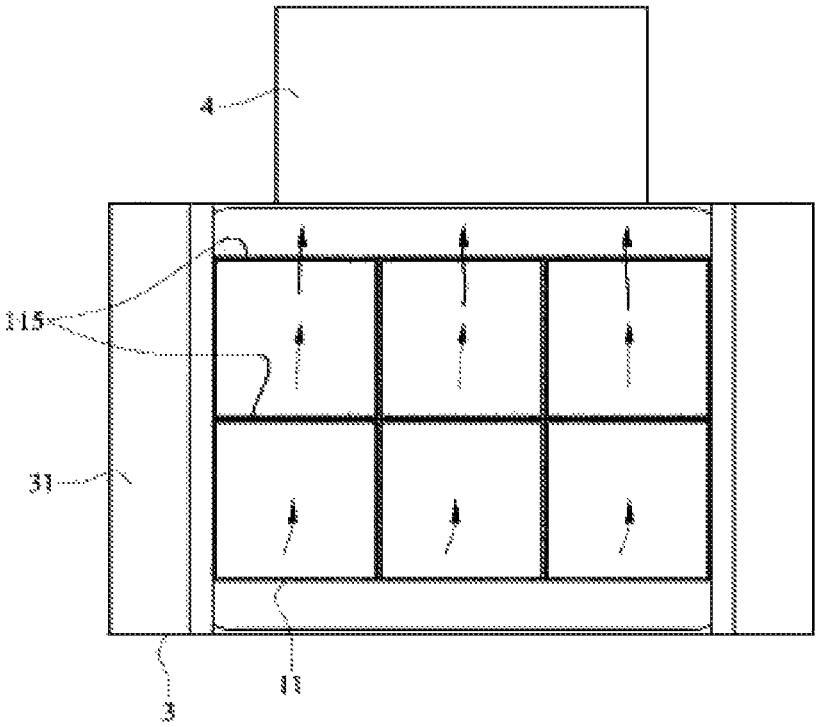
FIG. 10 is a high level view for describing an air flow in a dust suction apparatus in accordance with still another embodiment of the present disclosure.
Figure 11:
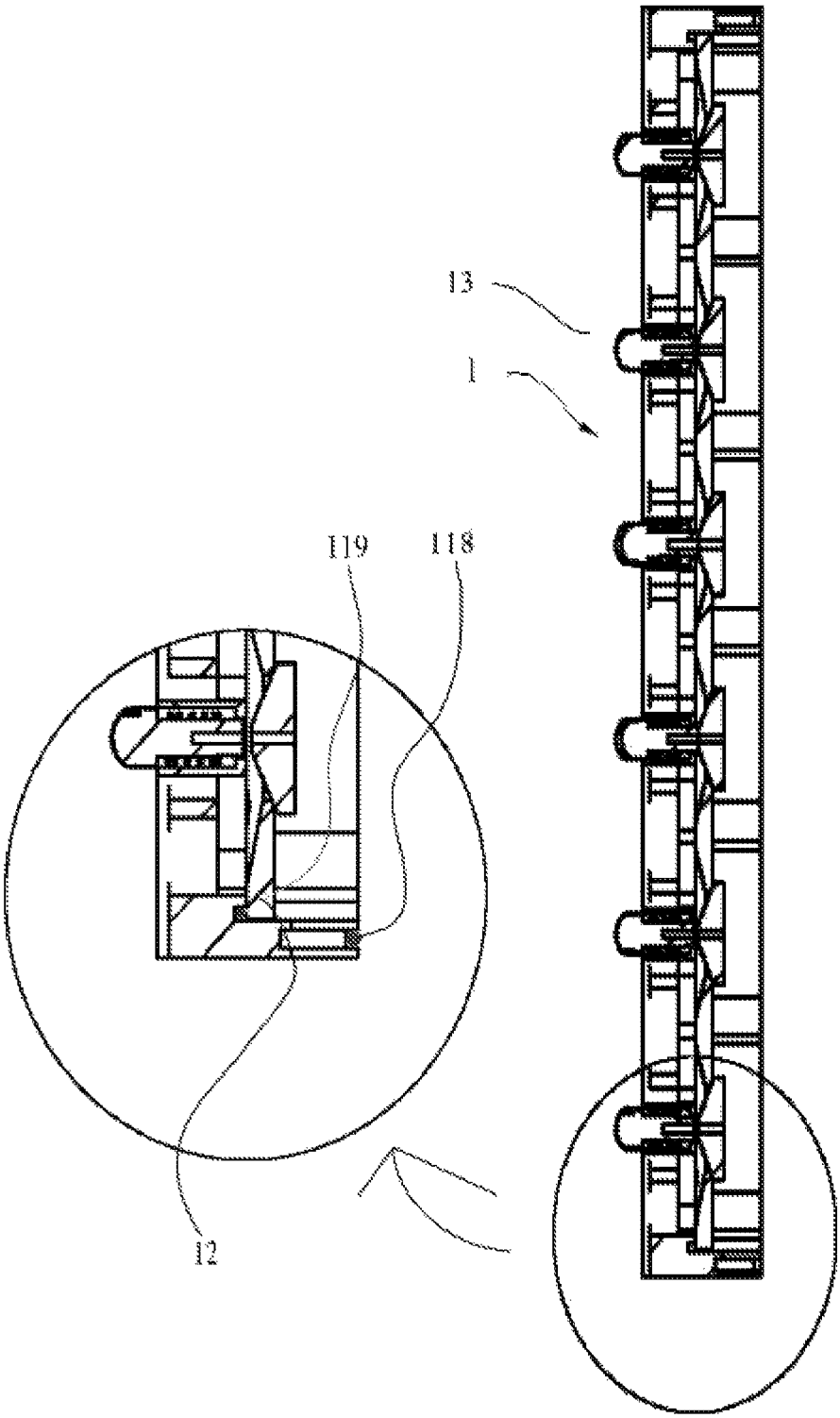
FIG. 11 is a perspective view of a configuration of a grating panel in accordance with still another embodiment of the present disclosure.

FIG. 8 is an exploded perspective view of a dust suction panel of a dust suction apparatus in accordance with still another embodiment of the present disclosure. FIG. 9 is a bottom perspective view of a grating panel and a bottom panel of a dust suction apparatus in accordance with still another embodiment of the present disclosure. FIG. 10 is a high level view for describing an air flow in a dust suction apparatus in accordance with still another embodiment of the present disclosure. FIG. 11 is a perspective view of a configuration of a grating panel in accordance with still another embodiment of the present disclosure.

Hereinafter, differences between the dust suction apparatus in this embodiment and the dust suction apparatus in the embodiment as shown in FIG. 1 may be focused on.

The dust suction apparatus in this embodiment may have the suction panel 1, base 2, frame 3 and grating panel 11 with substantially the same configuration as those in the dust suction apparatus in FIG. 1. In this embodiment, the bottom panel 12 may have lower support pins 125 to be arranged centrally in the second direction on the panel, 12 and a plurality of lower support spaced walls 124 extending between the through-holes 121 in the first direction perpendicular to the second direction. The plurality of lower support spaced walls 124 may be arranged in a symmetrical manner relative to the central pin 125. As shown in FIG. 11, a position of a third sealing 118 may vary.

Figure 12:
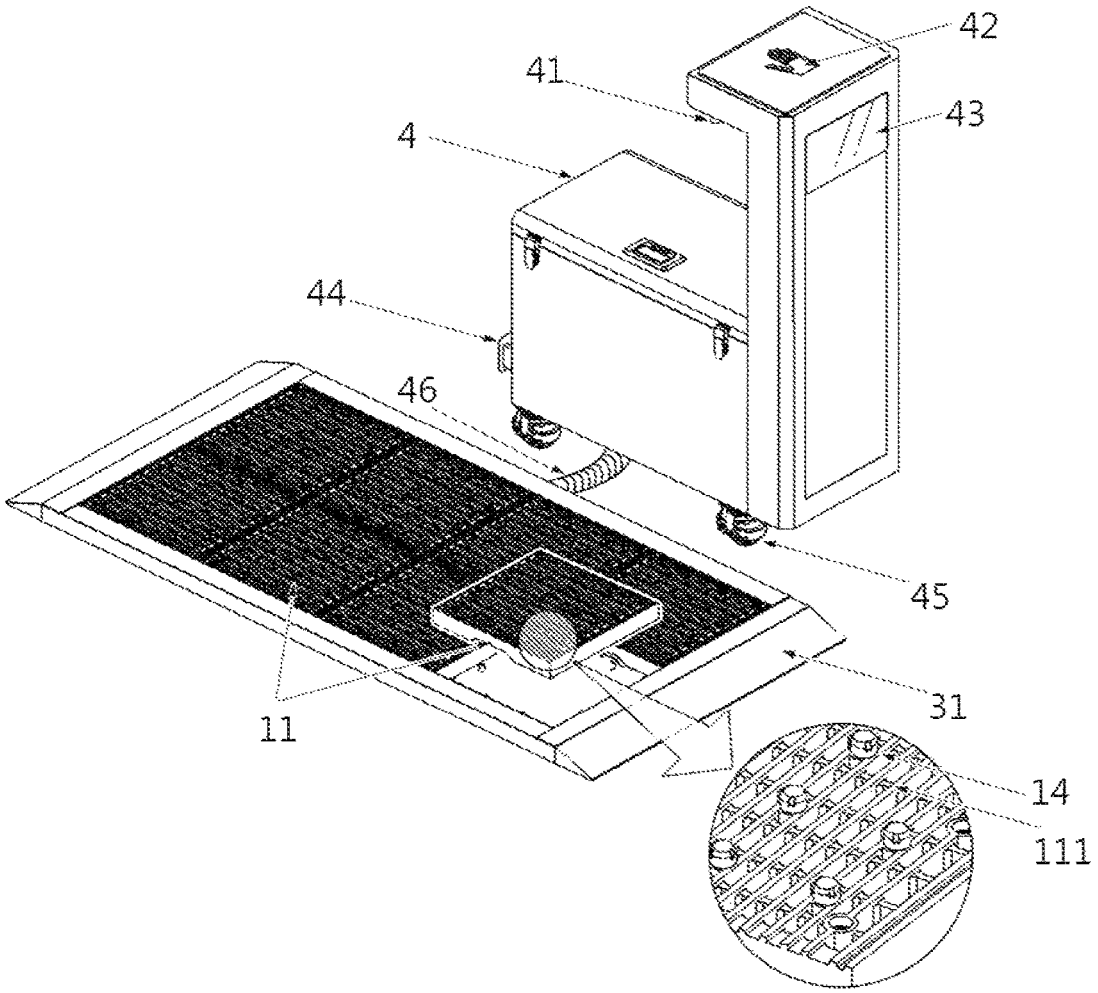
FIG. 12 is a perspective view of a dust suction apparatus in accordance with another embodiment of the present disclosure.

FIG. 12 is a perspective view of a dust suction apparatus in accordance with another embodiment of the present disclosure.

Hereinafter, differences between the dust suction apparatus in FIG. 12 and the dust suction apparatus in FIG. 1 may be focused on.

The dust suction apparatus may have the suction panel 1, base 2, frame 3 and grating panel 11 with substantially the same configuration as those in the dust suction apparatus in FIG. 1.

In this embodiment, the grating panels 11 may be removeably disposed on the base 2 and frame 3. That is, the grating panels 11 may be selectively replaced on the frame 3 as required. Thus, when grating panel 11 is polluted with the contaminant and/or the protrusion 13 is damaged to work poorly, the entire suction panel 1 is not removed but only the identified grating panel 11 is remove and replaced. This may lead to a comfortable maintenance of the present apparatus.

Figure 13:
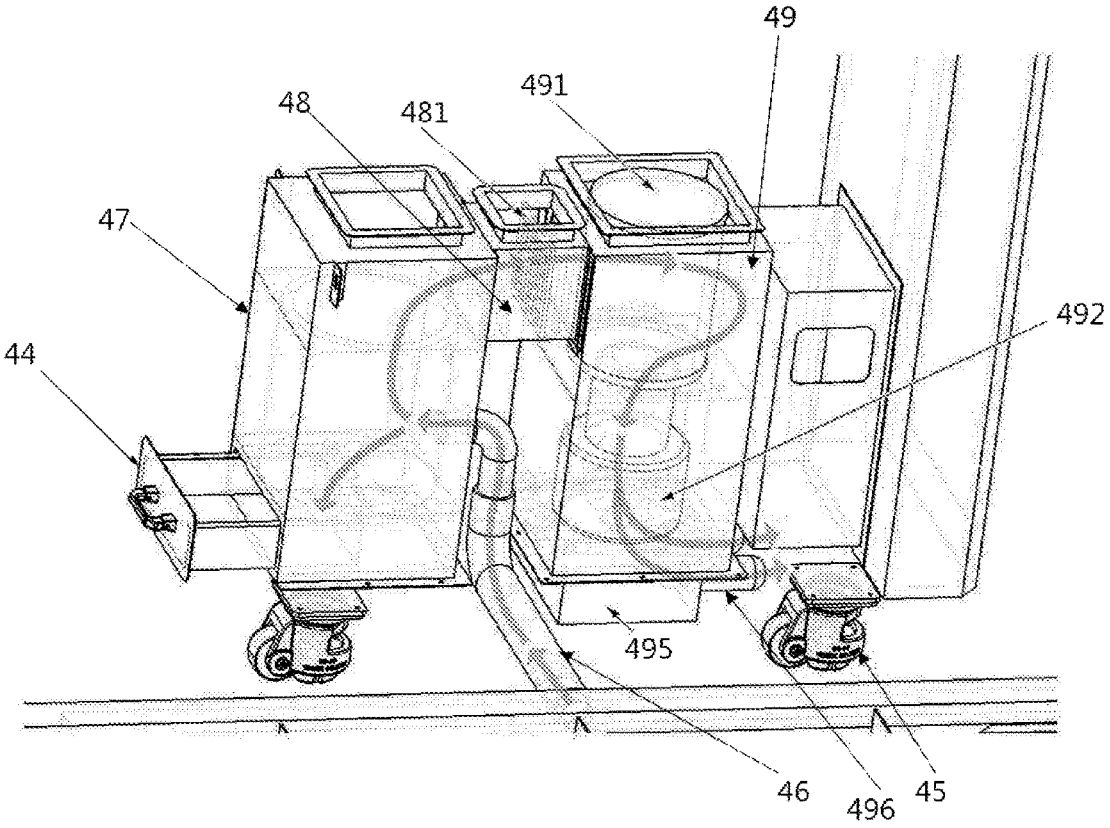
FIG. 13 is a detailed view of a dust-collection device in accordance with an embodiment of the present disclosure.

FIG. 13 is a detailed view of a dust-collection device in accordance with an embodiment of the present disclosure.

The dust-collection device 4 may include a first dust collection unit 47, a filter chamber 48 air-communicating with the first dust collection unit 47, a second dust collection unit 49 air-communicating with the filter chamber 48, a dust withdrawer 44 removeably coupled to the first dust collection unit 47, wheels 45 coupled to the dust collection units 47 and 49, a sensing unit 41, a passive sensor 42 separate from the sensing unit 41, and a display unit 43 coupled to an external device for advertisement. The dust-collection device 4 may be coupled to the dust suction panel 1 via a dust suction pipe 46 which may be embodied as a multi-step pipe or retractable-extendable pipe.

The first dust collection unit 47 may be configured to receive macro size dusts via the dust suction pipe 46 from the dust suction panel 1.

The second dust collection unit 49 may be configured to collect micro size dusts via the filter chamber 48 having a filtration micro-plate 481 and discharge the filtered air via an outlet 496 out of the second dust collection unit 49. The second dust collection unit 49 may have a muffler 495 disposed at a bottom thereof. The muffler 495 may reduce a noise generated from a dust collection using a motor 492 of the second dust collection unit 49.

The dust-collection device 4 may collect via the grating panel 11 of the suction panel 1 the dusts from 1 μm size dusts to various particles or harmful materials. The present apparatus may be installed in a front of a clean room or a specific building for a clean environment.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A dust suction apparatus comprising:

a base;

a side frame wherein the base and frame defines a dust suction space;

a dust suction panel disposed in the dust suction space; and a dust-collection device air-communicated with the dust suction panel, wherein the dust suction panel includes a plurality of dust suction panel modules, wherein the dust suction panel modules are mounted in the dust suction space in a modular fashion to allow the plurality of dust suction panel modules to be removed individually, wherein each dust suction panel module comprises a grating panel including;

a plurality of first spaced walls extending in a first direction;

a plurality of second spaced walls extending in a second direction perpendicular to the first direction;

a plurality of protrusion receiving structures, where each of the plurality of protrusion receiving structures has a protrusion receiving hole defined therein, wherein the plurality of protrusion receiving holes is arranged in a matrix form; and lateral walls to connect to each other to surround the first and second spaced walls, wherein each dust suction panel module further comprises a bottom panel coupled to the grating panel, wherein the bottom panel comprises a plurality of through-holes, each through-hole corresponding to each protrusion receiving hole of the grating panel, a tilted face portion extending around the through-hole, a plurality of spacer upper protrusions to be arranged to be spaced from each other, the plurality of spacer upper protrusions forming a space between the grating panel and a top end of the tilted face portion, and a plurality of lower support spaced walls extending between the through-holes in the first direction.

2. The apparatus of claim 1, wherein each dust suction panel module further includes a plurality of protrusions received in the protrusion receiving holes respectively.

3. The apparatus of claim 2, wherein each protrusion has an inwardly stepped portion, wherein, between the inwardly stepped portion and a bottom of the protrusion receiving structure, a compression coil spring is disposed.

4. The apparatus of claim 3, wherein the each protrusion has a screw hole formed therein centrally from a bottom thereof, wherein the screw hole communicates with the protrusion receiving hole.

5. The apparatus of claim 4, wherein a switching member is removeably coupled to each through-hole, wherein the switching member tapers upwardly, wherein the switching member has a mounting hole vertically defined centrally therein, and a fixing bolt passes through the mounting hole and is coupled to the screw hole of the each protrusion.

6. The apparatus of claim 1, wherein a top level of each of the first spaced walls is higher than a top level of each of the second spaced walls, wherein each of the protrusion receiving structures has a top level flush with the top levels of the first spaced walls and having a bottom level lower than the bottom levels of the first and second spaced walls.

7. The apparatus of claim 1, wherein each of the protrusion receiving holes has a main horizontal diameter, and each of the protrusion receiving structures has a bottom portion having a secondary hole defined therein having a smaller horizontal diameter than the main horizontal diameter.

8. The apparatus of claim 1, wherein each of the lateral walls has a bottom level lower than the bottom levels of the first and second spaced walls and the bottom levels of the protrusion receiving structures.

9. The apparatus of claim 1, wherein each of two facing-away lateral walls of the lateral walls has an air-communication hole.

10. The apparatus of claim 9, wherein the bottom panel has a plurality of lower support pins arranged in a line between the two air-communication holes and the lower support pins are spaced from each other.

11. The apparatus of claim 9, wherein one of two portions of the two facing-away lateral walls having the two air-communication holes respectively has an open bottom and protrudes along an inverse 'U' shape and outwardly.

12. The apparatus of claim 11, wherein a sealing groove is formed along and in the inverse 'U' shape of the air-communication hole portion, and a sealing is air-tightly received in the sealing groove, wherein the other of the two potions receives an air-communication hole portion with an inverse 'U' shape protrusion of a neighboring grating panel to pressure-contact the sealing received in the air-communication hole portion of the neighboring grating panel.

13. The apparatus of claim 1, wherein each of the lateral walls of the grating panel has a sealing groove defined in a bottom thereof, wherein the sealing groove receives therein a sealing.

14. The apparatus of claim 1, wherein each through-hole is larger than each protrusion receiving hole in a horizontal diameter.

15. The apparatus of claim 1, wherein the bottom panel has a sealing groove formed in and along an outer edge thereof, wherein a sealing is air-tightly received in the sealing groove and between the outer edge of the panel and the lateral wall of the grating panel.

16. The apparatus of claim 1, wherein the bottom panel includes lower support pins arranged in the second direction centrally thereon, and a plurality of lower support spaced walls extending between the through-holes in the first direction, and wherein the plurality of lower support spaced walls is arranged in a symmetrical manner relative to an arrangement of the central pins.

* * * * *